United States Patent [19]

Gressett, Jr. et al.

[11] Patent Number: 4,549,460

[45] Date of Patent: Oct. 29, 1985

[54] ELECTRIC BASS GUITAR INCORPORATING FINE-TUNING AND STRING LENGTH-ADJUSTING MEANS

[75] Inventors: Charles A. Gressett, Jr., Brea; Daniel J. Smith, La Habra, both of Calif.

[73] Assignee: Fender Musical Instruments Corporation, Brea, Calif.

[21] Appl. No.: 492,258

[22] Filed: May 6, 1983

[51] Int. Cl.[4] ..... G10D 3/14

[52] U.S. Cl. ..... 84/298; 84/312 R; 84/328

[58] Field of Search ..... 84/267, 297 R, 297 S, 84/298, 299, 307, 312 R, 312 P, 313, 328

[56] References Cited

U.S. PATENT DOCUMENTS

| | | | |
|---|---|---|---|
| 256,132 | 7/1980 | Wilson | D17/21 |
| 261,526 | 10/1981 | Carson | D17/21 |
| 261,527 | 10/1981 | Carson | D17/21 |
| 262,292 | 12/1981 | Carson | D17/21 |
| 262,376 | 12/1981 | Carson | D17/21 |
| 727,203 | 5/1903 | Roberts et al. | 84/299 |
| 973,846 | 10/1910 | Bendel | 84/297 R |
| 1,363,902 | 12/1920 | Muller | 84/297 S |
| 1,577,245 | 3/1926 | Bua | 84/312 R |
| 1,595,798 | 8/1926 | Marino | 84/299 |
| 2,007,861 | 7/1935 | Hoyt | 84/312 |
| 2,519,824 | 8/1950 | Cousineau | 84/312 R |
| 2,825,257 | 3/1958 | Witt | 84/313 |
| 4,201,108 | 5/1980 | Bunker | 84/1.16 |
| 4,361,068 | 11/1982 | Schaller | 84/299 |
| 4,366,740 | 1/1983 | Tripp | 84/298 |
| 4,378,723 | 4/1983 | Scholz | 84/297 |
| 4,408,515 | 10/1983 | Sciuto | 84/267 |
| 4,497,236 | 2/1985 | Rose | 84/298 |
| 4,506,585 | 3/1985 | Desmond | 84/298 |
| 4,512,232 | 4/1985 | Schaller | 84/313 |

FOREIGN PATENT DOCUMENTS

| | | |
|---|---|---|
| 540598 | 9/1921 | France . |
| 97263 | 12/1922 | Switzerland . |

*Primary Examiner*—Lawrence R. Franklin

*Attorney, Agent, or Firm*—Gausewitz, Carr & Rothenberg

[57] ABSTRACT

An electric bass guitar incorporating combination string-adjustment, fine-tuning, and bridge-elements. The bridge-elements are accurately adjustable to any position, and are so constructed and related that the lateral positions of the strings will be determined with great precision, regardless of the adjusted position of the saddles. Fine-tuning screws are interposed between the saddles and an anchor wall which both anchors the strings and anchors the ends of adjustment elements for the saddles. The strings are confined closely in vertical slots so that they may not move laterally but may move vertically as fine-tuning occurs. The fine-tuning screws engage the string portions in the slots.

6 Claims, 6 Drawing Figures

FIG. 1.
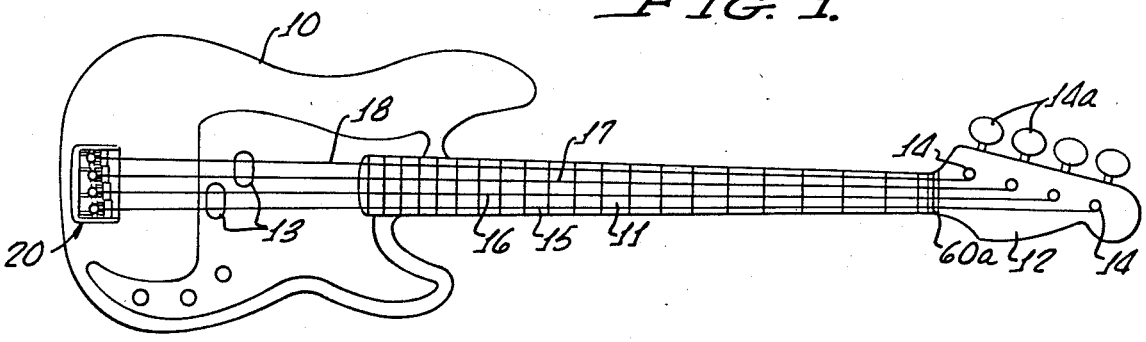
FIG. 2.
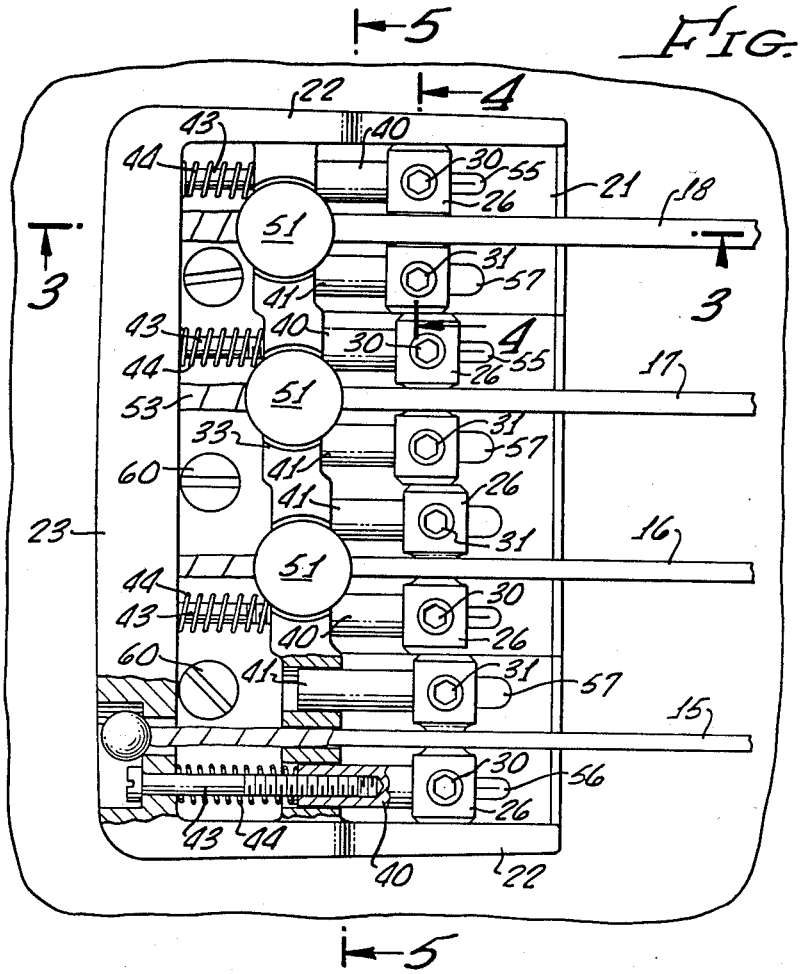
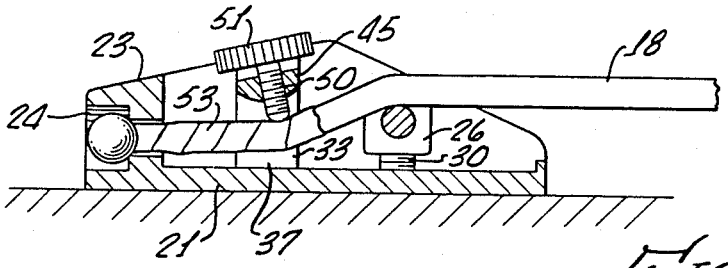
FIG. 3.

ELECTRIC BASS GUITAR INCORPORATING FINE-TUNING AND STRING LENGTH-ADJUSTING MEANS

BACKGROUND OF THE INVENTION

The achievement of correct fine-tuning of electric bass guitars is a difficult procedure which is often performed by means of an electric tuning instrument or meter. For example, it is difficult—because of the deep tones—for the musician to hear when correct intonation has been achieved. Furthermore, the operation is awkward, one reason being that the tuning machines are located on the heads of the bass guitars far from the regions where the strings are being plucked or strummed.

Furthermore, it is desirable for the musician to effect fine-tuning rapidly, and without becoming conspicuous, sometimes even during the course of a particular instrumental number. The need for such an operation may occur, for example, when the musician senses that one or more strings has becomed detuned as a musical performance progresses.

Despite the above factors, it has long been conventional practice to tune electric bass guitars by use of tuning machines only, such machines being located on the heads of the basses. When a tuning machine is operated, it not only involves a certain amount of awkwardness and conspicuousness, but it is more difficult for the musician to achieve the exact pitch desired.

As is well known, the tensions—and thus the pitches—of the strings of bass guitars are not the only factors which must be controlled in order for the instruments to play properly. There must also be correct string lengths, proper spacing of the strings above the fingerboard, and proper spacings between adjacent strings. Correct string length varies with certain factors, including string diameter, and is (for each separate string) caused to be such that the node of the fundamental will be located over a particular fret when the string is vibrating free (not contacted by the fingers of the bass guitarist). To achieve both the desired lengths of strings, and desired spacings above the fingerboard, without at the same time disturbing the lateral positions of the strings (proper spacing of the strings from each other, and from the edges of the neck), there must be individual vertically and longitudinally-adjustable bridge elements so constructed and mounted as to not "drift" laterally as the needed adjustments are effected, or at any time during playing of the instrument.

There has long been a need for a simple, rugged, reliable, aesthetically pleasing bass bridge which accomplishes all of the above-specified effects, yet does not generate any drawbacks in comparison to prior-art bass bridges. For example, some musicians use the heels of their hands to effect muting of the strings by pressing thereon immediately adjacent the bridges. While such muting is being effected, other portions of the hands are over the bridges themselves. Accordingly, it is important that a bass bridge not have a high profile, and not be characterized by the presence of elements which jut out (especially, upwardly) to any significant extent.

SUMMARY OF THE INVENTION

The present invention comprises anchoring means, vertically and longitudinally-adjustable saddle elements each adapted to act as a bridge for one of the strings of the guitar, and fine-tuning elements disposed between the anchoring means and the adjustable saddle elements, the fine-tuning elements being adapted to apply transverse pressure to the adjacent string portions, and thus accurately tune the strings.

Stated more particularly, the invention comprises, in addition to the anchoring elements and the vertically and longitudinally-adjustable saddle elements, track means to effect highly accurate lateral positioning of the saddle elements, regardless of the longitudinally-adjusted positions thereof. Guide means are interposed between the saddle elements and the anchoring means, and shaped to permit vertical movement of the string portions therebetween without permitting any substantial lateral movement of such string portions. The fine-tuning means comprise screws which engage tranversely the string portions thus guided by the guide means, to move the string portions tranversely and thereby change string tension and pitch.

In accordance with other aspects of the invention, elongated elements are extended through the guide means on opposite sides of the string portions therein, and are connected by screws to the anchoring means so that rotation of such screws effects longitudinal shifting of the vertically-adjustable saddle elements along the track means. Preferably, there are two such elongated elements for each saddle element, and such two elements straddle the string portion—and associated string-guide means—associated with the saddle element.

It is a feature of the present apparatus that there is only one effective track for each saddle, such track and saddle being so associated with each other as to permit substantially zero lateral movement of the saddle. In the preferred embodiment, such one track is a V-groove into which a substantially pointed set screw is inserted so that the set screw self-centers in the groove. The set screw is one of two set screws which are adjustable to determine the elevation of the saddle above the track. A second set screw for each saddle rides on a support, but such support is so constructed as not to be effective in laterally positioning the saddle.

BRIEF DESCRIPTION OF THE DRAWINGS

FIG. 1 is a plan view of an electric bass guitar incorporating the present invention;

FIG. 2 is an enlarged plan view of the bridge and fine-tuning means incorporated in the bass guitar;

FIG. 3 is a longitudinal sectional view on line 3—3 of FIG. 2;

DETAILED DESCRIPTION OF THE PREFERRED EMBODIMENT

Figure 4:
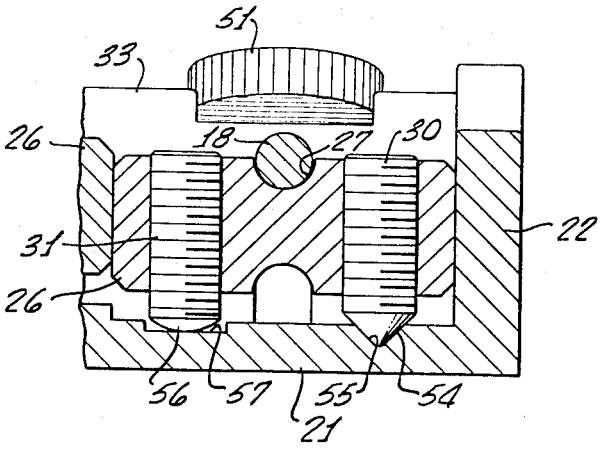
FIG. 4 is a greatly enlarged fragmentary sectional view on line 4—4 of FIG. 2.

The invention is described as incorporated in an electric bass guitar, but it is to be understood that some aspects of the invention may also be employed in a conventional Spanish guitar.

Referring to FIG. 1, the electric bass guitar is illustrated to comprise a body 10, neck 11, head 12, pickups 13, and tuning pegs 14, each of which is part of a standard manually-operated tuning machine **14*a* incorporating reduction gearing. Four strings 15–18 are stretched between pegs 14 and the combination bridge and fine-tuning apparatus, generally represented by the number 20**.

The illustrated preferred form of the bridge and fine-tuning apparatus 20 comprises a die-cast body having a bottom wall 21, sidewalls 22, and a rear wall 23 which forms an anchor means for the strings 15–18 and also for elements which adjust the longitudinal positions of saddle elements described subsequently.

Figure 6:
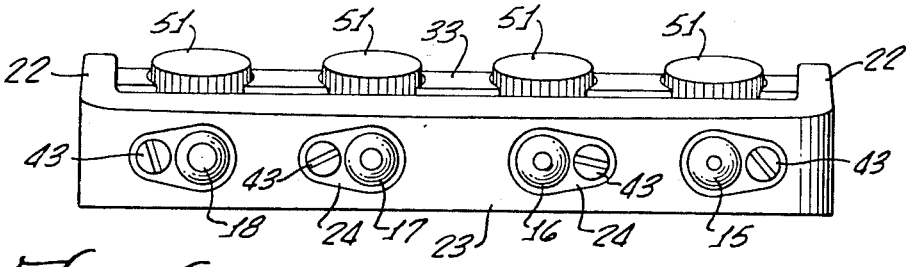
FIG. 6 is a rear elevational view of the bridge and fine-tuning apparatus.

Preferably, the ball-ended ends of strings 15–18 are disposed in recesses 24 (FIGS. 3 and 6) formed in anchor wall 23 on the side thereof remote from head 12 of the electric bass.

Four saddle elements 26 are provided, one for each of the strings 15–18. Each saddle 26 is transversely elongated, and each has a downwardly-concave (at the upper portion thereof) central groove 27 (FIG. 4) adapted to receive and center an associated string (for example, the string 18 shown in FIG. 4).

Each of the saddles 26 has two set screws, respectively numbered 30 and 31, threaded vertically therethrough at opposite end portions of the saddle. When the set screws 30 and 31 are turned, by a wrench, the elevation of the associated saddle 26 and thus the associate string 15, 16, 17, or 18 may be changed markedly, as desired by the musician.

Figure 5:
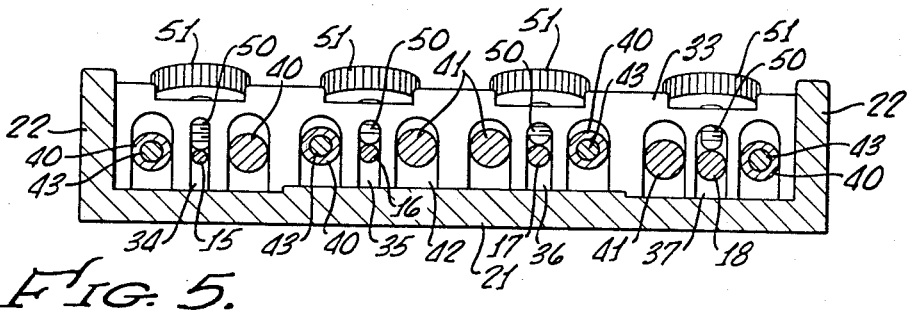
FIG. 5 is an enlarged transverse sectional view taken on line 5—5 of FIG. 2.

Guide means are interposed between the saddles 26 and the anchor wall 23 of the bridge body. Preferably, such guide means includes a complex wall 33 that is integrally die cast with the body (namely, with its bottom wall 21, sidewalls 22, and rear wall 23). As best shown in FIG. 5, wall 33 has four vertically-elongated slots 34–37 of different widths. Such slots are sized to receive in relatively close-fitting, but nonbinding, relationship the four strings 15–18 of the bass. For example, string 18 is large in diameter, since it is the one which generates the lowest-pitched tones. Thus, its vertical slot 37 is relatively wide, as shown at the right portion of FIG. 5. The opposed vertical sidewalls of the respective slots 34–37 prevent, because of the indicated slot widths, any substantial lateral movements of the string portions confined therein.

Not only is the wall 33 vertically slotted to receive the respective strings, but also to receive barrels which perform connecting and loose-guiding functions. Two barrels 40 and 41 are connected to the rear side of each saddle element 26, each barrels 40 being internally threaded, and each barrels 41 being solid.

Referring to FIG. 5, wall 33 is formed with eight vertical slots 42 to receive the eight barrels (four barrels 40 and four barrels 41). There are two slots 42 for each string slot 34, 35, 36 and 37, such two slots 42 being parallel to, and on opposite sides of, the associated string slot.

Slots 42 for the barrels guide such barrels relatively loosely, permitting not only a large amount of vertical movement of the barrels but also a substantial, but limited, amount of lateral movement thereof. Stated otherwise, the barrels are not close fits in the slots therefor.

Elongated adjustment screws 43 are extended through bores in wall 23 and threaded into the internally-threaded barrels 40, reference being made to the lower portion of FIG. 2. The slotted heads of the adjustment screws 43 seat in recesses 24 (FIG. 6) adjacent the ball-ends of strings 15–18. A helical compression spring 44 is mounted coaxially around the shank of each screw 43, and seated between wall 23 and the rear end of a barrels 40. Springs 44 cause the barrels 40, and thus the associated saddles 26 and barrels 41, to be in the farthest positions from anchor wall 23 permitted by the adjustment of screws 43.

The upper regions of wall 33 are preferably solid, not slotted, but are bored and internally threaded at points directly above the guide slots 34–37 for the strings. One such bored and threaded portion of wall 33 is indicated at 45 in FIG. 3, being directly above slot 37 for the largest-diameter string 18. Preferably, the threaded bore is inclined upwardly and in a direction away from head 12 of the bass.

Finely-threaded fine-tuning screws 50 are threaded into the indicated bores and have (preferably) rounded lower ends which bear against string portions between bridge elements 26 and wall 23. The fine-tuning screws 50 preferably have large-diameter flat heads 51, the diameters of which are substantially larger than the width of wall 33.

Again referring to FIG. 3, the fine-tuning screws 50 are (because of the above-indicated inclinations of the threaded bores through wall portions 45, FIG. 3) generally perpendicular to the string portions which they engage.

In the bass guitar, those string portions relatively adjacent the ball-ends which seat on outer portions of wall 23 are wrapped, as by nylon, rayon, or other suitable wrapping. The wrapped regions are shown at 53, and in many instances the wrapped regions extend into the guide slots 34–37 for the strings. Thus, frequently, the fine-tuning screws 50 engage wrapped regions 53 of the respective strings 15–18.

As best shown in FIGS. 4 and 2, the previously-mentioned set screws 30 and 31 are differently constructed, as are the portions of wall 21 therebeneath. The bottom end of each set screw 30 is generally conical or pointed, as shown at 54 in FIG. 4. Such bottom end extends into a V-groove or track 55 which is longitudinal to strings 15–18 and perpendicular to rear wall 23.

Conversely, the bottom end of each set screw 31 is not pointed, but instead is, preferably, rounded, as shown at 56. Rounded portion 56 seats on an underlying flat region 57 of wall 21. Each region 57 also extends parallel to the strings 15–18, but is not a track because it does not determine the position of any saddle 26. Instead, each flat region 57 is merely a low-friction region which supports the associated saddle 27 at a longitudinal position (longitudinal of the strings) determined solely by an adjustment screw 43, and at a lateral position (lateral of the strings) determined solely by set screw 30 and its pointed lower end 54 and associated V-track 55. As previously indicated, the barrels 40 and 41 provide rough or loose guiding of the saddles 26, and assure that such saddles are maintained generally in the desired positions, even when the bass guitar is not strung.

As shown in the drawings, various regions of the bridge casting are stepped and recessed. For example, referring to FIG. 5, the central regions of bottom wall 21 are higher than are the outer regions thereof, this being to conform the bridge to the curvature of the upper side of guitar neck 11 (such upper side, namely, the upper surface of the fingerboard, being part of a large-diameter imaginary cylinder, the axis of which is far below—and parallel to—neck 11 and lies in a vertical plane bisecting neck 11).

Referring to FIG. 2, the wall 33 which defines the above-specified guide surfaces for the strings and other elements is likewise stepped, in such manner that the portion of wall 33 adjacent string 15 (which is a less low-pitched string) is closer to head 12 than is the portion of wall 33 for the low-pitched string 18.

The upper side of wall 33 is recessed for each tuning-screw head 51. Thus, when each head 51 is turned inwardly as far as it will go, the upper surface of each relatively flat head 51 is only slightly above the upper surface of wall 33.

OPERATION

The bridge body is integrally die cast (or, far less preferably, injection-molded) with all of its walls, slots, grooves, recesses, etc., formed during the die-cast process. All saddle elements 26 are preferably identical, as are all adjustment screws 43 and springs 44. Thus, it is a very simple operation to assemble the bridge, following which it is mounted on the guitar body 10 by means of screws 60, shown in FIG. 2.

The strings 15–18 are then threaded through the bores in anchor wall 23 of the bridge body, passing through slots 34–37, beneath tuning screws 50, and over the central grooves 27 in the saddles. (It is to be noted that the downwardly-concave grooves 27 center even the less-large diameter strings, for example, string 15.) The strings are then connected to the pegs 14 and tensioned by the tuning machines **14*a***.

The musician then employs set screws 30 and 31 to determine the elevation of each string, employs the adjustment screws 43 to determine the position of each saddle longitudinally of the strings, and employs the tuning machines **14*a* to bring the strings to the approximate desired pitches. Thus, the effective lengths of the strings (such effective length being that between the saddles and the topnut 60*a* at the outer end of neck 11) are determined, together with the desired elevations of the strings above the neck 11**.

To easily fine-tune the bass guitar, at any time and even during a performance, the musician uses his fingers to rotate the heads 51 of tuning screws 50 to create greater or lesser lateral bearing force on the wrapped regions 53 of the strings 15–18. Because the tuning screws have very fine threads, as do the internally-threaded bores formed in wall 33, the precise pitches are readily achieved—often by means of an electrical tuning device or a meter. The strings create pressures on the tuning screws to prevent undesired turning thereof due to vibration of the strings, even though the screws are (preferably) relatively loose fits in their threaded bores.

It is known that each string will be exactly where it should be, that is to say spaced laterally from the adjacent strings and from the outer edges of guitar neck 11, because of the conjoint operation of V-tracks 55 (FIG. 4), the self-centering elements inserted therein, and the walls of slots 34–37. As described, such self-centering elements are the pointed (conical) lower ends of set screws 30.

The described fine-tuning means do not interfere with muting of the strings by the heel of one hand of the bass guitarist, it being conventional for some guitarists to place their hands on the strings immediately adjacent the saddles, other portions of such one hand being over the bridge itself.

Because of the precise guiding of the strings, all of the tuning screws may have the same diameter for economy of production, yet it is assured that each confined string (FIG. 5) may not slip laterlly away from the tuning screw bearing down on it.

Beacuse, with most bass guitar strings, the fine-tuning screws bear down on wrapped portions 53 and not on the metal string portions (it being understood that strings for bass guitars have cores that are helically wrapped by metal wires to as to cause the strings to be relatively large in diameter and thus low in pitch), the strings provide relatively soft seats for the tuning-screw ends, and (conversely) such ends tend not to create damage to the strings, despite the relatively large forces that are involved for the fine-tuning operations.

It is emphasized that by having only one guide-track for each saddle element, and one associated self-centering screw end inserted into such guide track, there is much greater precision of lateral adjustment of the saddles, as well as less chance that the set screws will move out of the saddles should (for example) one of the two set screws for each saddle be turned downwardly much farther than the other—thus causing the saddle to incline. With two tracks and associated set screws, there can be "opposition" between the set screws at the two ends of the saddle, so that at one time one set screw may be in correct position, at another time the other may be in correct position, and at other times neither. These variations occur due to manufacturing tolerances, relative adjustment of the set screws, and other factors. All of these problems are eliminated when only a single track and set screw are employed to determine lateral positioning of the saddle.

The foregoing detailed description is to be clearly understood as given by way of illustration and example only, the spirit and scope of this invention being limited solely by the appended claims.

What is claimed is:

1. An electric bass guitar, comprising:

(a) a bass guitar body, neck, and head, said head having a tuning machine thereon for each string, (b) bass guitar strings connected to said tuning machines and extended over said head and a portion of said body, and (c) a combination string-adjustment, bridge, and fine-tuning apparatus mounted on said body and associated with said strings, said apparatus comprising a saddle element for each of said strings and serving as the bridge therefor, means to adjust each of said saddle elements longitudinally of said strings, means to adjust each of said saddle elements upwardly and downwardly relative to the face of the guitar body to thus determine the heights of the strings over the body and over the neck, means to anchor said strings at regions disposed on the opposite sides of said saddle elements from said head, and fine-tuning means disposed on the opposite sides of said bridge elements from said head, and between said bridge elements and said anchor means, to bear laterally against the portions of said strings between said saddle elements and said anchor means and thereby change the string tensions and thus the pitches of said strings, said fine-tuning means being fine-tuning screws that bear against said portions of said strings, said portions of said strings being wrapped, whereby to provide seats for said screws and to prevent or minimize damage to said strings by said screws despite the major pressures involved in the fine-tuning operations.

2. A bridge for an electric guitar, incorporating:

(a) a plurality of saddle elements disposed above a support plate, and (b) two screws extended downwardly through the saddle element to effect vertical adjustment thereof, one of the screws having a pointed lower end and seating in a V-groove track therebeneath, the other screw not seating in any groove which positions the same and tends to prevent lateral movement of the saddle.

3. A combination bridge, hand rest, and fine-tuning apparatus for bass guitars, said apparatus comprising:

(a) body means adapted to be mounted on the top surface of a bass guitar, said body means comprising a bottom wall, an anchor wall, and a guide wall, all of said walls being rigidly connected and presenting a relatively low profile;

(b) said anchor wall extending transverse of said body means and forming means for anchoring one end of the strings of said bass guitar;

(c) said guide wall extending adjacent and generally parallel to said anchor wall, said guide wall incorporating vertical slots, there being one vertical slot for each guitar string, said slots being sized to confine said strings against excessive lateral movement, and a threaded aperture above each said vertical slot;

(d) bridge means mounted on said bottom wall and located on the opposite side of said guide wall from said anchor wall; and (e) fine-tuning screws threaded into said threaded apertures and adapted to bear against the portions of said strings in said slots to effect fine tuning of said strings by changing the tension thereof, said screws having relatively large-diameter flat heads, whereby the anchor wall, guide wall, and flat heads provide a comfortable, rigid hand rest for the bass guitar player.

4. The invention of claim 3, in which there is a separate bridge means for each of said strings, each bridge means including a saddle element for supporting its associated string, and in which means are provided to effect longitudinal and vertical adjustment of each such separate saddle element.

5. The invention as claimed in claim 4, in which at least one barrel is connected to each of said saddle elements and extended through a vertical slot in said guide wall, and in which an adjustment screw is extended through said anchor wall and threaded into said barrel, whereby turning of the adjustment screw effects movement of the barrel and thus the connected saddle longitudinally of the associated string.

6. The invention as claimed in claim 5, in which two parallel barrels are connected to each of said saddle elements and extended through separate vertical slots in said guide wall, one of said barrels being said barrel that receives said adjustment screw.

* * * * *